US005818015A

United States Patent [19]

Lee et al.

[11] Patent Number: 5,818,015

[45] Date of Patent: Oct. 6, 1998

[54] POWER SUPPLY CUT-OFF APPARATUS OF MICROWAVE OVEN

[75] Inventors: Jung-Ho Lee, Seoul; Young-Won Cho, Suwon, both of Rep. of Korea

[73] Assignee: Samsung Electronics Co., Ltd., Suwon, Rep. of Korea

[21] Appl. No.: 872,131

[22] Filed: Jun. 10, 1997

[30] Foreign Application Priority Data

| | | | |
|---|---|---|---|
| Jul. 1, 1996 | [KR] | Rep. of Korea | 1996 19549 U |
| Jul. 1, 1996 | [KR] | Rep. of Korea | 1996 19550 U |
| Feb. 25, 1997 | [KR] | Rep. of Korea | 1997 5829 |

[51] Int. Cl.[6] ..... H05B 6/68

[52] U.S. Cl. ..... 219/723; 219/715; 219/756; 200/50.14; 200/61.62; 126/197

[58] Field of Search ..... 219/723, 722, 219/724, 756, 702, 715; 200/50.02, 50.14, 50.08, 50.1, 61.62, 61.76, 61.81; 126/197

[56] References Cited

U.S. PATENT DOCUMENTS

| | | | |
|---|---|---|---|
| 3,691,329 | 9/1972 | Ball | 219/722 |
| 4,277,659 | 7/1981 | DeRemer | 200/61.62 |
| 4,321,445 | 3/1982 | Kristof et al. | 219/722 |
| 5,235,150 | 8/1993 | Buske et al. | 219/722 |

FOREIGN PATENT DOCUMENTS

| | | | |
|---|---|---|---|
| 52-37241 | 3/1977 | Japan | 219/723 |
| 55-56534 | 4/1980 | Japan | 219/722 |

*Primary Examiner*—Philip H. Leung
*Attorney, Agent, or Firm*—Burns, Doane, Swecker & Mathis, L.L.P.

[57] ABSTRACT

A microwave oven includes a case forming a cooking chamber, and an outer panel mounted to the case. The outer panel is to be separated from the case when performing certain maintenance or repairs. Electrical terminals are mounted on the case and outer panel to perform the function of automatically disconnecting power to the oven in response to removal of the outer panel. A first arrangement of terminals can be provided for performing that function in the event of a removal of the outer panel in an upward direction. A second arrangement of terminals can be provided for performing that function in the event of a removal of the outer panel in a rearward direction.

6 Claims, 6 Drawing Sheets

POWER SUPPLY CUT-OFF APPARATUS OF MICROWAVE OVEN

BACKGROUND OF THE INVENTION

1. Field of the Invention

The present invention relates to a power supply cut-off apparatus of a microwave oven by which an input power supply can be automatically cut off when an outer panel is separated in a state of an electric cord still being plugged in an outlet.

2. Description of the Prior Art

A conventional microwave oven, as illustrated in FIGS. 1 and 2, includes a cooking chamber 60, a front panel 20, a back panel 30, a base panel 40 and an outer panel 50, a turntable 70 disposed on a floor of the cooking chamber 60, a door 80 for opening and closing an opening of the cooking chamber 60, and a control unit 90 for establishing a cooking selection mode or for operating a magnetron (not shown) and the like.

In order to drive the microwave oven thus constructed, when a door-open button at the manipulating unit 90 is pressed while an electric cord 100 still in an outlet, the door 80 is opened to light a lamp in the cooking chamber 60.

At this time, food is placed on the turntable 70 disposed on the floor of the cooking chamber 60, the door 80 is closed, desired cooking time and cooking menu and the like are input by the manipulating unit 90, and a start button is pressed. Then the turntable 70 is rotated in one direction, as a high frequency of 2,450 MHZ is generated according to an oscillating operation of a magnetron (not shown) to thereafter be dispersed in the cooking chamber 60.

The high frequency dispersed in the cooking chamber 60 is reflected from metal walls 10 therein and is radiated to the food on the turntable 70 to thereby heat the food.

However, there is a problem in the conventional microwave oven thus constructed in that an electric shock to a worker can happen because there is no safety measure to automatically cut off the power supply applied to the microwave oven when the outer panel 50 is separated in a state while the electric cord 100 is still plugged in the outlet during a repair or maintenance of the product.

SUMMARY OF THE INVENTION

Accordingly, the present invention is provided to solve to aforementioned problem and it is an object of the present invention to provide a power supply cut-off apparatus of a microwave oven by which an input power supply can be automatically cut off to thereby prevent an electric shock to a worker even if the outer panel is separated in a state where an electric cord is still plugged in an outlet during a repair or maintenance of the product.

In accordance with an object of the present invention, there is provided a power supply cut-off apparatus of a microwave oven, the apparatus comprising:

a first adapter disposed at an inner surface of an outer panel; and a second adapter disposed at an external side of a cavity and electrically connected at one side thereof to an electric cord so as to be separated from the first adapter when the outer panel is taken off upward to thereby cut off a power supply in the product.

In accordance with another object of the present invention, there is provided a power supply cut-off apparatus of a microwave oven, the apparatus comprising:

an electric cord disposed at a rear side of an outer panel;

an adapter disposed at a rear side of a back panel so as to automatically turn on or turn off a 3-wire power supply connected to the electric cord when the outer panel and the back panel are assembled and dismounted; and a terminal where the adapter and the power supply 3-wire are connected and disconnected so as to assemble and dismount the back panel to and from electronic parts and the like in the product.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE PREFERRED EMBODIMENTS OF THE INVENTION

Figure 1:
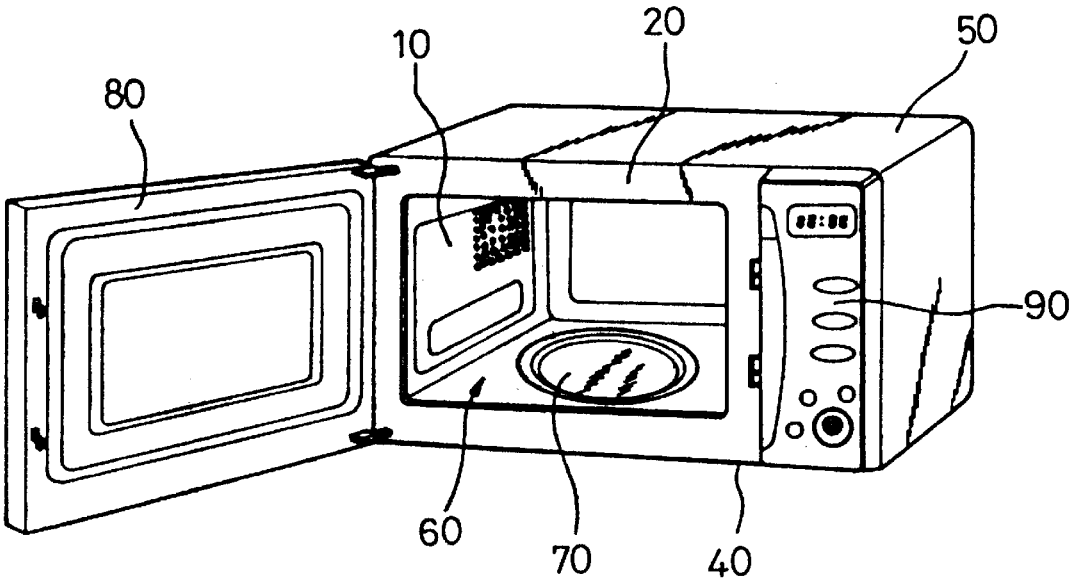
FIG.1 (PRIOR ART)
FIG. 1 is a front perspective view of a microwave oven according to the prior art.
Figure 2:
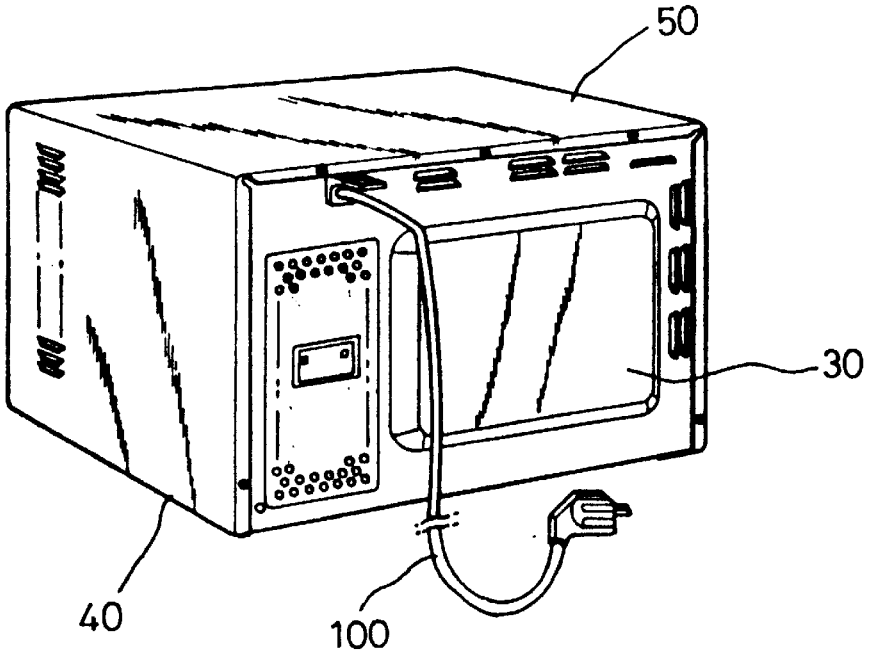
FIG.2 (PRIOR ART)
FIG. 2 is a rear perspective view of a microwave oven according to the prior art.

The foregoing and other objects as well as advantages of the present invention will become clear by way of the following detailed description of the invention with reference to the accompanying drawings.

Throughout the drawings, like reference numerals and symbols are used for designation of like or equivalent parts or portions for simplicity of illustration and explanation.

A power supply cut-off apparatus of a microwave oven according to the first embodiment of the present invention includes, as illustrated in FIGS. 3 through 6, a first or upper adapter 210 disposed on an inner ceiling surface of an outer panel 50, and a second or lower adapter 220 disposed on a top side of a cooking chamber-forming case 10 and electrically connected to an electric cord 100. The second adapter 220 is separated from the first adapter 210 when the outer panel 50 is taken off upward to thereby cut off a power supply to the product.

Figure 5:
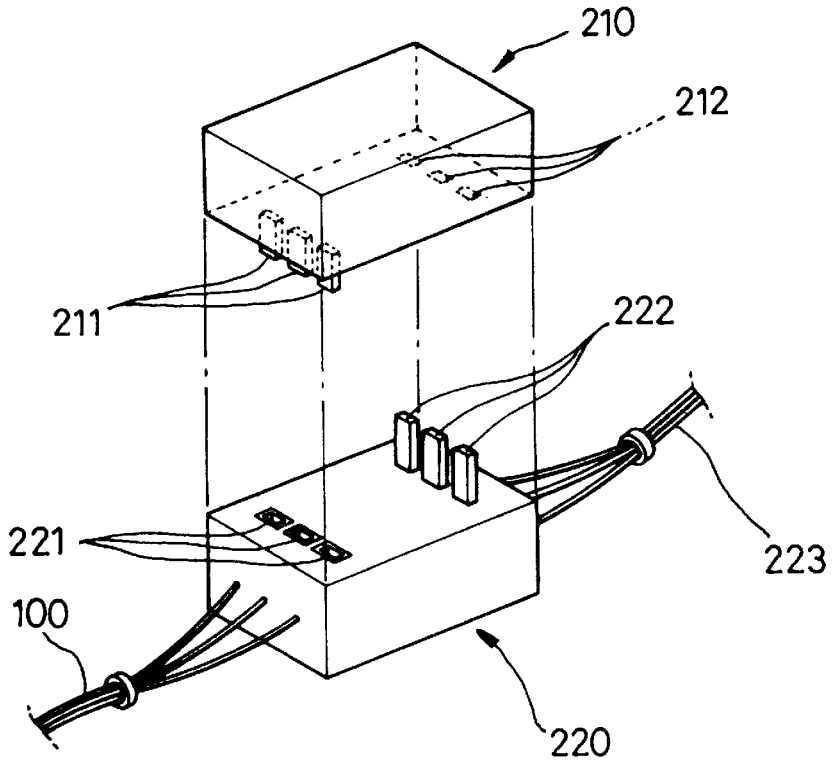
FIG. 5 is an exploded perspective view of a first adapter and second adapter of FIG. 4.
Figure 6:
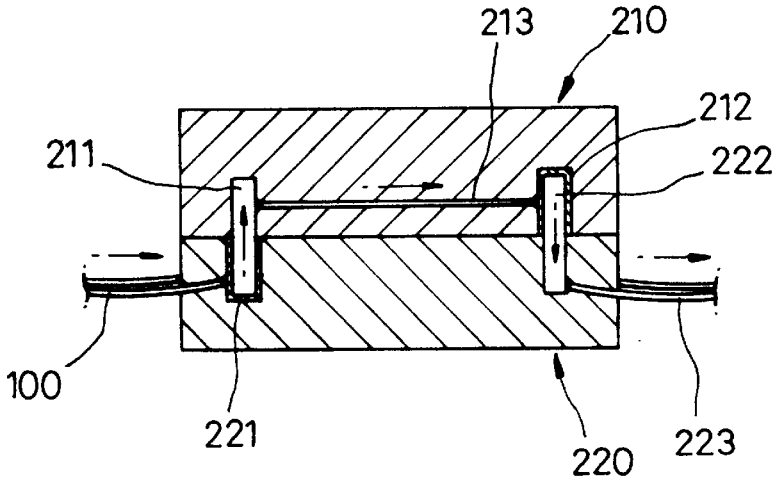
FIG. 6 is an assembled sectional view of FIG. 5.

At this time, the first adapter 210 has a body 210' provided at one end of a lower side thereof, as illustrated in FIGS. 5 and 6, with a set of three male connecting terminals 211 to be connected to a 3-wire power supply of the second adapter 220, and at the other end thereof with a set of three female connecting terminals 212 so as to be respectively connected to the 3-wire power supply of the second adapter 220.

The three male connecting terminals 211 and the three female connecting terminals 212 are provided with three inner electric cords 213 extending therebetween in the body 210' so as to be respectively electrically interconnected.

Meanwhile, the second adapter 220 has a body 220' provided at one end of a top side thereof, as illustrated in FIGS. 5 and 6, with a set of three female connecting terminals 221 so as to be respectively connected to the male connecting terminals 211 of the first adapter 210, and provided at the other end thereof with a set of three male connecting terminals 222 so as to be respectively connected to the three female terminals 212 of the first adapter 210.

At this time, the three female connecting terminals 221 are, as illustrated in FIG. 6, respectively connected to a 3-wire electric cord 100 inserted into the second adapter 220 via the back panel 30, and the three male connecting terminals 222 are respectively connected to a 3-wire power supply connecting cord 223 affixed to electronic parts (not shown) in the product.

Now, the operational effect of the power supply cut-off apparatus of a microwave oven according to the embodiment of the present invention thus constructed will be described.

When a user unscrews a plurality of fastening bolts (no reference numeral designated) disposed at an external rear side of the outer panel 50 for repair or maintenance, the outer panel 50 and the back panel are separated.

Figure 3:
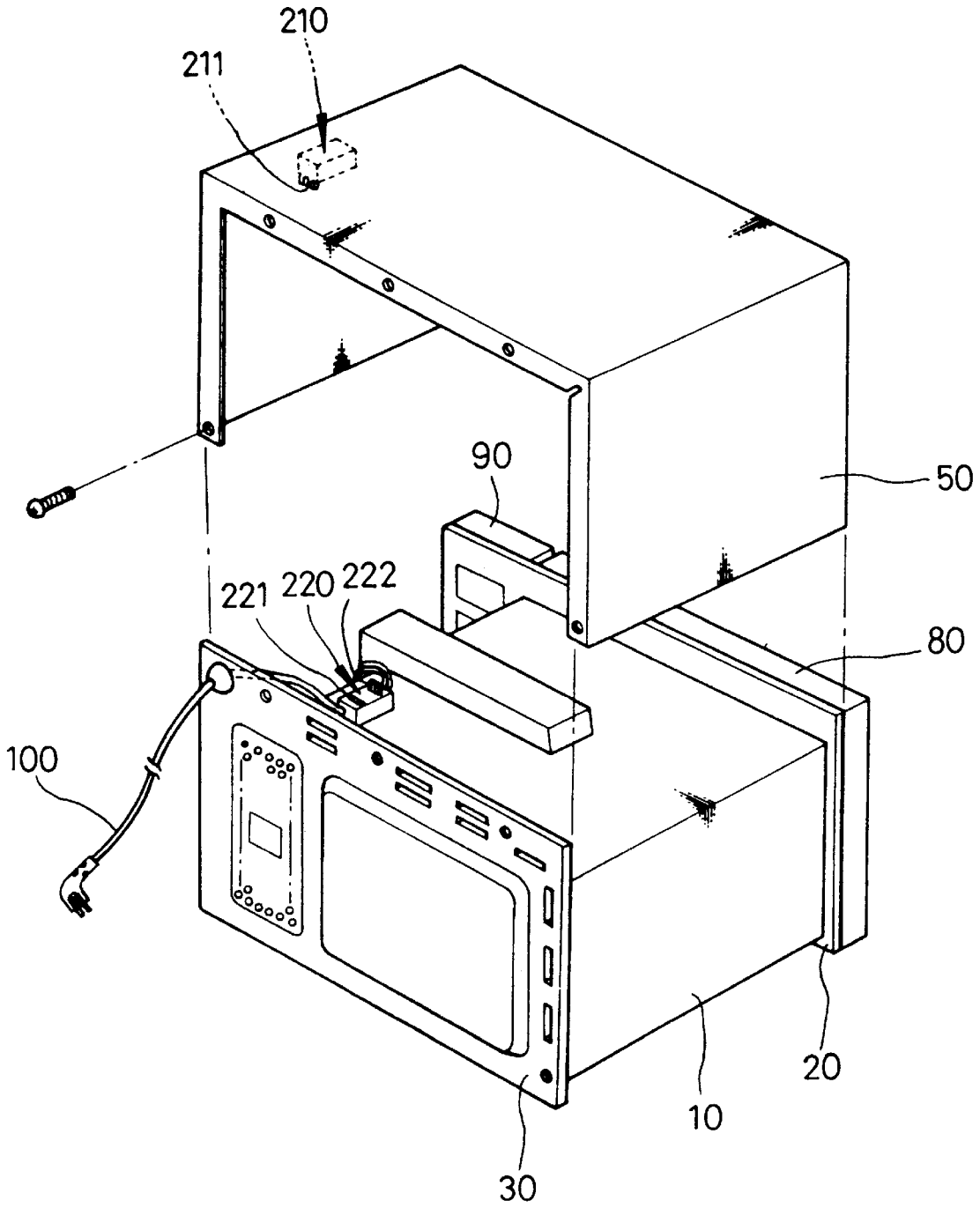
FIG. 3 is a rear top exploded perspective view of a microwave oven having a power supply cut-off apparatus according to a first embodiment of the present invention.
Figure 4:
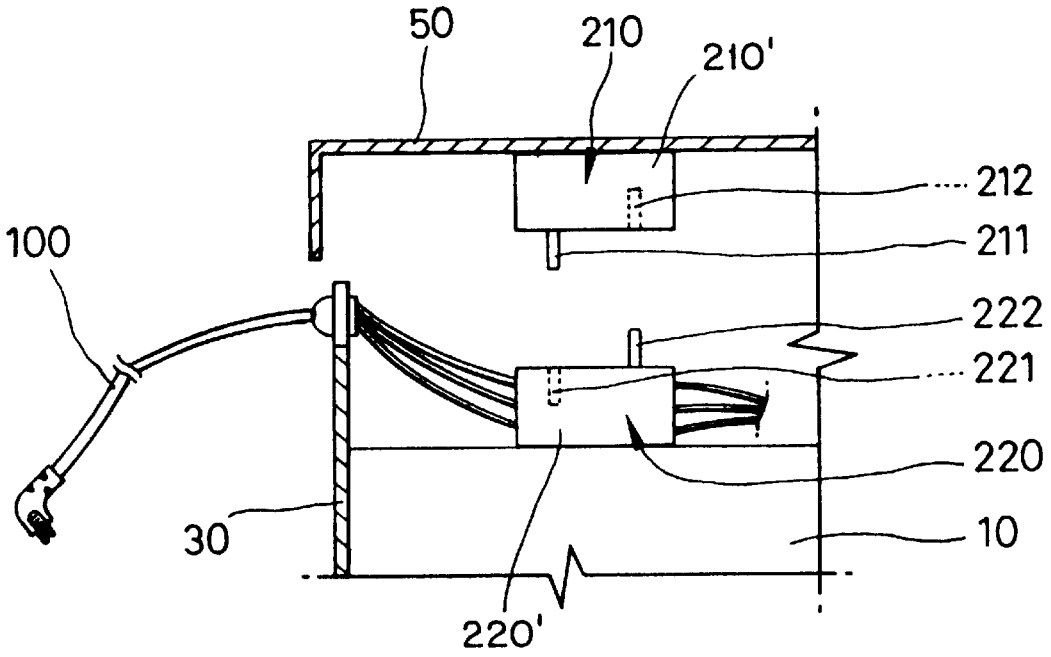
FIG. 4 is an exploded sectional view of the power supply cut-off apparatus of FIG. 3.

When the outer panel 50 is lifted upward as illustrated in FIG. 3, the first adapter 210 is automatically separated from the second adapter 220.

Thus, the power supply applied to the product via the electric cord 100 is automatically cut off if the electric cord 100 is still plugged in an outlet, thereby preventing the worker from receiving an electrical shock.

Meanwhile, when the repair is finished the male connecting terminals 211 and the female connecting terminals 212 are inserted into the female connecting terminals 221 and the male connecting terminals 222 when the outer panel 50 is pressed downward, whereby the first and the second adapter 210 and 220 are mutually reassembled as illustrated in FIG. 6.

At this time, the electric current flowing through the electric cord 100 connected to one side of the second adapter 220 simultaneously flows to the female connecting terminals 221 of the second adapter 220 in the indicated arrow direction, and the current flowing toward the male connecting terminals 211 flows along an inner electric cord 213 between the male connecting terminals 211 and the female connecting terminals 212 in the first adapter 210 and concurrently flows toward the male connecting terminals 222 of the second adapter 220.

The current flowing to the male connecting terminals 222 flows in the second adapter 220 toward the connecting electric cord 223, which then supplies the power to electronic parts in the product.

Meanwhile, screw holes (no reference numeral designated) at the outer panel 50 and the back panel 30 are mutually aligned when the first adapter 210 and the second adapter 220 are assembled, so that the worker can reinsert the fastening screws As explained in the afore-said description, there is an advantage in the power supply cut-off apparatus of a microwave oven according to the present invention, in that the first adapter disposed at the outer panel and the second adapter formed at the cavity are automatically separated at the 3-wire power supply to thereby cut off the power supply and to prevent the worker from receiving an electrical shock.

Now, the second embodiment of a power supply cut-off apparatus of a microwave oven according to the present invention will be described with reference to the accompanying drawings.

Throughout the drawings, like reference numerals and symbols as used for designation of like or equivalent parts or portions as in the first embodiment for simplicity of illustration and explanation and redundant references will be omitted therefrom.

Figure 7:
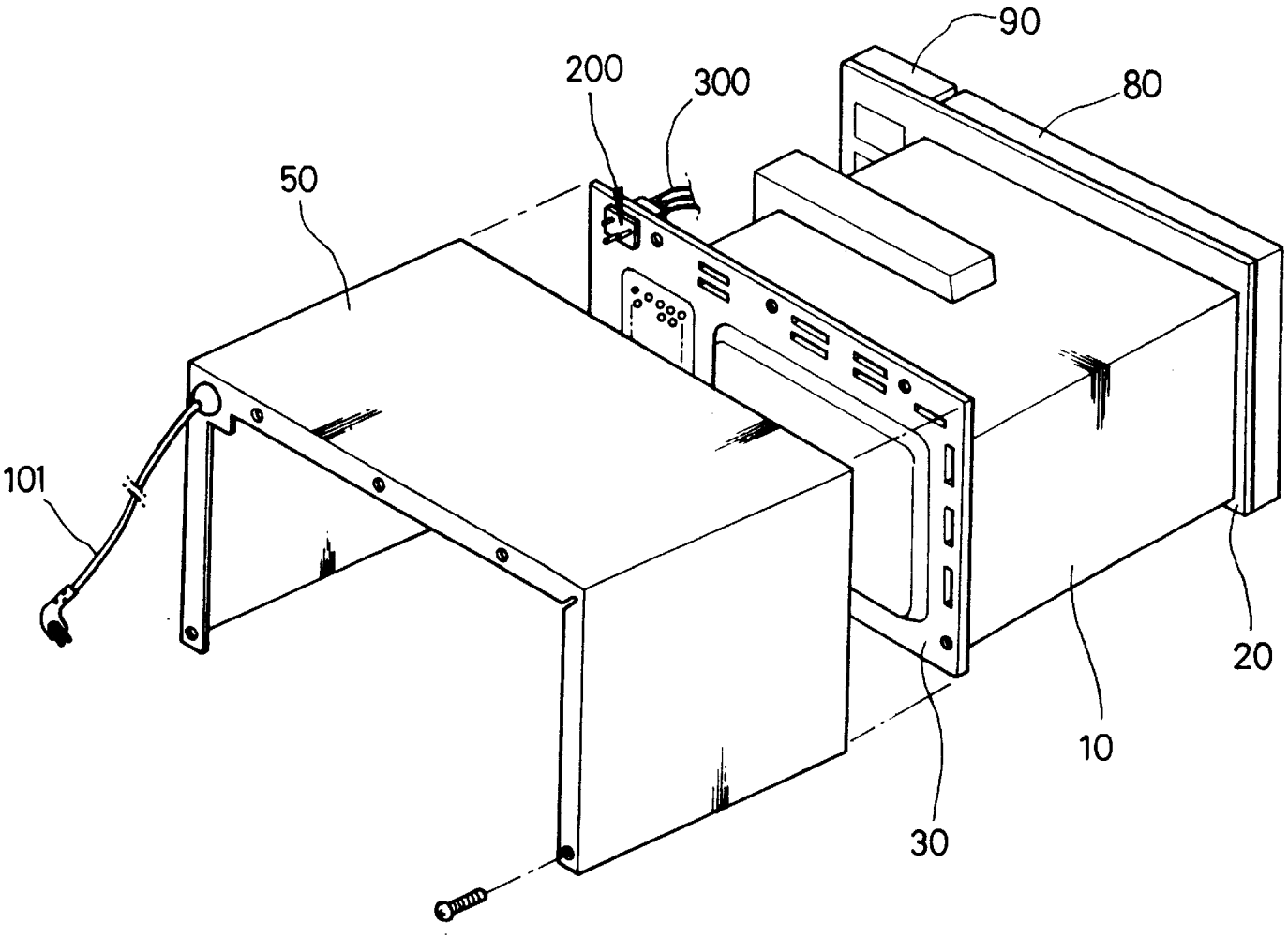
FIG. 7 is a rear, top exploded perspective view of a microwave oven having a power supply cut-off apparatus according to a second embodiment of the present invention.
Figure 8:
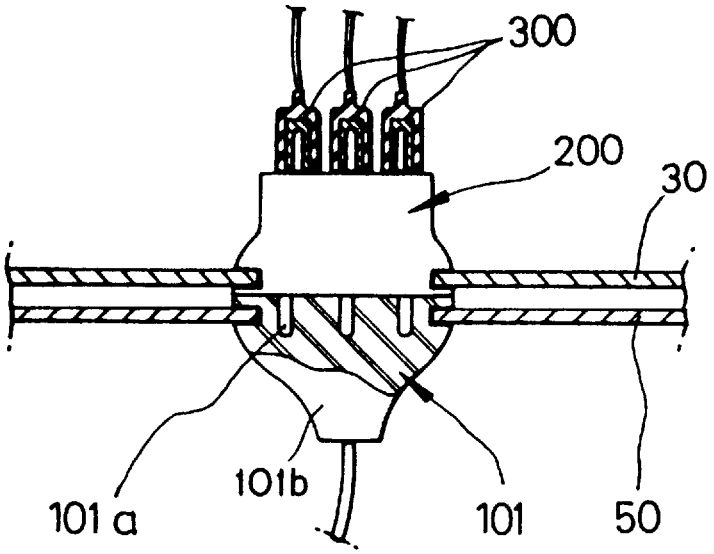
FIG. 8 is a partial sectional view of the power supply cut-off apparatus according to the second embodiment illustrated in FIG. 7.

The power supply cut-off apparatus according to the second embodiment of the present invention includes as illustrated in FIGS. 7 and 8: (i) an electric cord 101, (ii) a rearwardly facing adapter 200 disposed at a rear side of the back panel 30 to automatically activate or deactivate a 3-line power supply connected to the electric cord 101 when the outer panel 50 and the back panel 30 are assembled or separated to prevent the worker from receiving an electric shock with the electric cord still being plugged in an outlet, and (iii) three terminals 300 interconnecting the adapter 200 with electrical components of the oven.

The power supply electric cord 101 has a forwardly facing plug 101*b* formed with three female terminals 101*a* to prevent an electric shock when the adapter 200 is disconnected.

Next, the operational effect of the power supply cut-off apparatus of a microwave oven according to the second embodiment of the present invention will be described.

When fastening screws (no reference numerals designated) disposed at an external side of the outer panel 50 are separated for repair of the product (microwave oven), and the outer panel 50 is pulled backward, the outer panel 50 is separated from the back panel 30 to cause the electric cord 101 to be separated from the 3-wire power supply of the adapter 200, so that the power supplied to the product through the electric cord 101 plugged in an outlet (not shown) is automatically cut off and an electric shock can be prevented.

Furthermore, because the terminal 101*a* of the electric cord 101 connected to the adapter 200 is formed in female shape, an electric shock can be prevented in advance which occurs when the outer panel 50 and the back panel 30 are separated even with the electric cord 101 still being plugged in the outlet.

The adapter 200 is connected to the terminal 300 via the 3-wire power supply, so that there is an advantage of easy performance of repairs of electronic parts in the product.

As apparent from the foregoing, there is an advantage in the power supply cut-off apparatus of a microwave oven, in that an input power supply can be automatically cut off when an outer panel is separated even if an electric cord is still plugged into an outlet, thereby preventing a worker from receiving an electrical shock.

What is claimed is:

1. A microwave oven comprising:

a case forming a cooking chamber for receiving microwaves;

an outer panel mounted on the case and being removable therefrom in an upward direction;

a main electrical supply cord for supplying electrical power to electrical components of the microwave oven; an upper adapter mounted beneath the outer panel;

a lower adapter mounted above the case in a space formed between the outer panel and the case, the lower adapter being electrically connected to the electric cord;

the upper and lower adapters including terminals that are automatically disconnected from one another in response to the outer panel being separated upwardly from the case, and automatically connected to one another in response to the outer panel being inserted downwardly onto the case.

2. The microwave oven according to claim 1, wherein the upper adapter comprises an upper body, an upper set of three male terminals projecting downwardly from the upper body, an upper set of three downwardly open female terminals disposed in the upper body, and three wires disposed in the upper body and interconnecting the male terminals with respective ones of the female terminals.

3. The microwave oven according to claim 2 wherein the lower adapter comprises a lower body, a lower set of three upwardly open female terminals disposed in the lower body and removably receiving the three downwardly projecting male terminals, respectively, a lower set of three male terminals projecting upwardly from the lower body and received in respective ones of the downwardly open female terminals; the main electrical supply cord including three electrical wires electrically connected to one of the lower sets of terminals; and three connecting cords electrically interconnecting the other of the lower sets of terminals with electrical components of the microwave oven.

4. The microwave oven according to claim 2 wherein the lower adapter comprises a lower body, a lower set of three upwardly open female terminals disposed in the lower body, and a lower set of three male terminals projecting upwardly from the lower body; the main electrical supply cord including three electrical wires electrically connected to one of the lower sets of terminals; and a connecting cord including three wires interconnecting the other set of electrical terminals with electrical components of the oven.

5. A microwave oven comprising:

a case forming a cooking chamber for receiving microwaves, the cooking chamber including a forwardly facing opening;

an outer panel mounted on the case and being removable therefrom in a rearward direction;

a three-wire main electrical supply cord for supplying electrical power to electrical components of the microwave oven, the main supply cord including a forwardly facing plug; and an adapter mounted on the case to be rearwardly facing, the adapter electrically connected to electrical components of the microwave oven;

the plug and adapter each having three terminals automatically detached from one another in response to rearward separation of the outer panel from the case, and automatically attached to one another in response to forward insertion of the outer panel onto the case.

6. The microwave oven according to claim 5 wherein the terminals in the plug comprise female terminals.

* * * * *